US007823318B2

(12) United States Patent
Hall

(10) Patent No.: US 7,823,318 B2
(45) Date of Patent: Nov. 2, 2010

(54) RIFLE RECOIL ABSORPTION SYSTEM

(76) Inventor: Thomas W. Hall, 612 18th Ave. South, Nampa, ID (US) 83651

( * ) Notice: Subject to any disclaimer, the term of this patent is extended or adjusted under 35 U.S.C. 154(b) by 196 days.

(21) Appl. No.: 12/269,157

(22) Filed: Nov. 12, 2008

(65) Prior Publication Data

US 2009/0119967 A1 May 14, 2009

Related U.S. Application Data

(60) Provisional application No. 60/987,129, filed on Nov. 12, 2007.

(51) Int. Cl.
*F41C 27/00* (2006.01)

(52) U.S. Cl. ..... 42/94

(58) Field of Classification Search ..... 42/94
See application file for complete search history.

(56) References Cited

U.S. PATENT DOCUMENTS

| | | | | | |
|---|---|---|---|---|---|
| 3,876,078 | A | * | 4/1975 | Gomes et al. | 211/64 |
| 4,012,860 | A | * | 3/1977 | Auger | 42/94 |
| 4,799,324 | A | * | 1/1989 | Nodo | 42/94 |
| 4,971,208 | A | * | 11/1990 | Reinfried et al. | 211/64 |
| 5,628,135 | A | * | 5/1997 | Cady | 42/94 |
| 5,682,700 | A | * | 11/1997 | Sandberg | 42/94 |
| 5,758,447 | A | | 6/1998 | Venetz | |
| 5,811,720 | A | * | 9/1998 | Quinnell et al. | 89/37.04 |
| 6,672,492 | B1 | | 1/2004 | Thompson | |
| 2006/0230664 | A1 | | 10/2006 | Eddins | |
| 2007/0074439 | A2 | | 4/2007 | Cauley et al. | |

* cited by examiner

*Primary Examiner*—Troy Chambers
(74) *Attorney, Agent, or Firm*—Robert L. Shaver; Dykas, Shaver & Nipper, LLP

(57) ABSTRACT

The present invention is directed towards a rifle recoil absorption system comprising a harness attached to a rifle support and shooting surface for absorbing recoil force generated when a high powered rifle is fired.

19 Claims, 1 Drawing Sheet

RIFLE RECOIL ABSORPTION SYSTEM

CROSS-REFERENCE TO RELATED APPLICATIONS

This application claims the priority date of the provisional application entitled Recoil Strap filed by Thomas W. Hall on Nov. 12, 2007, with application Ser. No. 60/987,129.

FIELD OF THE INVENTION

The present invention generally relates to an apparatus for absorbing rifle recoil, and more particularly to absorbing rifle recoil and kick back force while preventing excess movement of the rifle after each shot fired from the rifle.

BACKGROUND OF THE INVENTION

High powered rifles are very popular for both target shooting as well as hunting. There are a number of reasons rifle users desire to absorb recoil while firing a high-powered rifle. For example, rifle users who fire repetitive shots from high-powered rifles are subjected to large impact forces from the butt of the stock of the rifle. These impacts can bruise, fatigue, and often injure the user of the rifle. Rifle recoil absorption is desirable in order to minimize these undesired physical impacts to the user.

Another important reason for the absorption of rifle recoil is to prevent excess movement of the rifle during and after each shot fired from the rifle. Accuracy and precision of the shots fired are diminished if the high-powered rifle is allowed to uncontrollably recoil. Also, if recoil is not suppressed, the user of the rifle has to re-aim the weapon after each shot, reducing the number of shots that can be accurately fired in a given time.

The suppression and absorption of recoil is especially important when adjusting the sighting of a high-powered rifle. It is important to have steady firing conditions when sighting a rifle so that the fired mark on a target can be trusted as a reference for adjusting the sight of the rifle. If a rifle is allowed to uncontrollably recoil, the user may have increased difficulty in setting the sights on his weapon.

In order to solve the problems associated with firing a high powered rifle, rifle recoil absorption systems are commonly known. For example, U.S. Pat. No. 5,758,447 is directed to a recoil absorbing device and method. This rifle recoil system is directed generally to a strap that is attached to the butt of the rifle for absorbing recoil. The device in a preferred embodiment uses a weighted bag resting on a horizontal support surface to absorb recoil. Potential problems with this device include that that strap does not run parallel to a horizontally resting rifle thus apparently the strap does not absorb recoil force at the same angle from which the force is generated. This could potentially lead to the problem of the absorption system not maximizing recoil absorption. Additionally, the weighted bag is not attached to the table; it merely rests on the table and therefore the bag may absorb the full amount of recoil and may not transfer recoil force to the table. Furthermore, the device does not appear to provide for a kick back absorption mechanism, where in kick back is generally considered to be the force generated when the rifle is fired that generally forces the rifle up away from the barrel rest.

Another example of a recoil reduction system amongst multiple examples is found in U.S. Pat. No. 5,811,720. In this system the device is also mountable to a horizontal surface. The system involves a strap attached to the system as well as to the butt of the rifle such that when the rifle is fired the rifle recoil force is distributed to the recoil reduction device. The structure houses a series of rubber balls in a compression mechanism such that when the rifle is fired, the recoil energy is generally absorbed through the strap attached to the butt of the rifle and transferred to the rubber balls. A potential problem with this device is that the device itself is relatively large and potentially cumbersome to transport. Additionally, this device does not appear to be easily attached and removed from the shooting surface as it appears large and bulky.

Accordingly an object of the invention is to provide a rifle recoil absorption mechanism to absorb when a rifle is fired.

Another object of the invention is to provide a rifle recoil absorption system that is mountable on a variety of surfaces.

A further object of the invention is to provide a recoil absorption system that also absorbs kick back forces generated when a rifle is fired.

Another object of the invention is to provide a system wherein recoil is absorbed to minimize the amount of rifle movement when a rifle is fired to facilitate a user firing multiple rounds within a short amount of time.

These and other objects will become clear to those having ordinary skill in the art upon viewing the invention as a whole.

SUMMARY OF THE INVENTION

The present invention is a recoil absorption system that is comprised of lightweight materials that are easily stored and easy to transport. The present invention is composed of band type material such as textile webbing in a preferred embodiment. The webbing is configured in a number of loops that serve as a structure or harness that attaches to the rifle. A large loop of the webbing material is configured to run along both sides of the forestock and stock of the rifle and wrap around the butt of the stock. This large loop of material is held in place by smaller loops of material attached to the large loop. The smaller loops are attached to the large loop in two places. The first small loop is attached to the large loop such that the small loop wraps around the stock of the rifle near the butt. The second small loop is attached to the large loop so that the second small loop wraps around the forestock and barrel of the rifle. Both small loops are typically adjustable using a hook and loop system and may accommodate rifle stocks and forestocks of varying diameters.

After the harness is attached to the rifle, the rifle may be placed on a horizontal firing surface. The recoil absorption system can then be attached to the firing surface. The present invention also requires the barrel and/or forestock of the rifle to be supported by some type of firing support such that the barrel may rest in the horizontal firing position.

In a preferred embodiment, the present invention utilizes an attachment strap that is stitched to the second small loop on the rifle harness mentioned above. The rifle is positioned on the table, for instance, such that the attachment strap hangs from its attachment to the harness and is allowed to hang over the front edge of the table nearest the muzzle of the rifle. In order to attach the recoil absorption device to the table, the attachment strap is pulled underneath the table and attached to the rear edge of the table nearest the butt of the stock of the rifle. The end of the attachment strap is fixed to the table by a U-shaped clamp that may be temporarily fixed to the rear edge of the table. Once the clamp is fixed to the rear edge of table, a tightening mechanism such as a come-a-long cam may be used to reduce the slack in the attachment strap between the rifle and the U-shaped clamp. This removal of slack and tightening of the attachment strap ensures that the recoil generated while firing the rifle is transferred to the table.

In another embodiment, the harness is comprised of a loop configured for extending around the rifle butt and extending towards the muzzle of the rifle. The loop has two extensions that are configured generally adjacent to the stock and forestock of the rifle and the loops are configured to absorb recoil force when the rifle is fired. A second loop and a third loop are configured to extend from the first loop such that the second loop extends around the barrel and forestock of the rifle and the third loop extends over and around the stock of the rifle to hold the first strap of the harness in place relative to the stock of the rifle. This loop is configured to absorb rifle kick back force when the rifle is fired. The first loop of the harness extends around the rifle support and around the front edge of the firing surface to a tensioning means. The tensioning means is configured such that the harness can be tightened and loosened to fit different sized rifles and absorb the recoil generated when the rifles are fired. The tensioning means is generally attached to a C-style clamp that is attached to the rear edge of the firing surface. The tensioning means is generally attached to the C-clamp via an attachment strap. Additionally, in this embodiment the second loop and the third loop can be configured to be adjustable to fit rifles of varying sizes. The first loop and second loop are generally adjustable using a hook and loop system in this embodiment.

The invention described above may easily be disconnected from the table and remain on the rifle while carrying the weapon. The invention is also easily removed from the rifle and stowed in a compact manner. The textile webbing construction of the device allows for relatively easy stowing, weighs a relatively small amount, and occupies a relatively small amount of space in comparison to the prior art.

The purpose of the foregoing Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
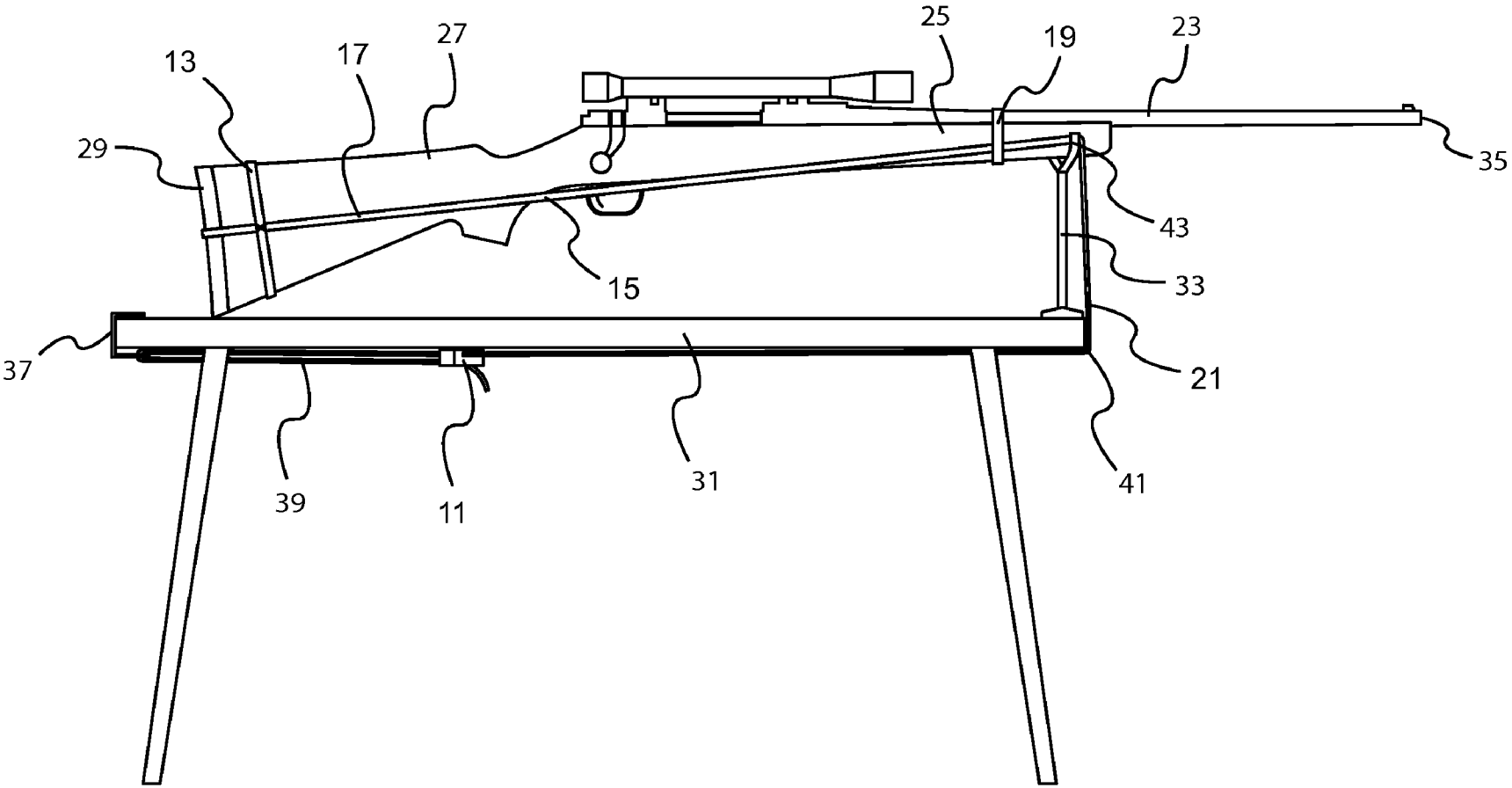
FIG. 1 is a view of the rifle harness attached to a rifle in a firing position.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The invention is directed to a harness for absorbing recoil and kick back forces when a rifle is fired. The system is designed to be attached to a shooting surface and a rifle support such that when the rifle is fired, the harness transfers the recoil and kick back forces to the shooting surface. In this manner the recoil absorption system absorbs recoil that would otherwise be transferred to the shooter.

In the following description and in the figures, like elements are identified with like reference numerals. The use of "or" indicates a non-exclusive alternative without limitation unless otherwise noted. The use of "including" means "including, but not limited to," unless otherwise noted.

FIG. 1 depicts a preferred embodiment of the recoil absorption system attached to a rifle in a firing position. The present invention is a recoil absorption system that is comprised of lightweight materials that are easily stored and easy to transport. In a preferred embodiment, the present invention is composed of band type material such as textile webbing. The webbing is configured in a number of loops that serve as a structure or harness 15 that attaches to the rifle. A large loop 17 of the webbing material is configured to run along both sides of the forestock 25 and stock 27 of the rifle and wrap around the butt 29 of the stock 25. This large loop 17 of material is held in place by smaller loops 13, 19 of material attached to the large loop 17. The smaller loops 13, 19 are attached to the large loop 17 in two places. The first small loop 13 is attached to the large loop 17 so that the small loop 13 wraps around the stock 27 of the rifle near the butt 29. This small loop 13 is fixed or stitched to the large loop 17 on either side of the stock 27 such that the small loop 13 is positioned roughly perpendicular to the large loop 17. The second small loop 19 is attached to the large loop 17 such that the second small loop 19 wraps around the forestock 25 and barrel 23 of the rifle. The second small loop 19 is also fixed or stitched to the large loop on either side of the forestock 25 such that the small loop 19 is oriented roughly perpendicular to the large loop 17. Both small loops 13, 19 are adjustable and may accommodate rifle stocks and forestocks of varying diameters. This is accomplished in a preferred embodiment by the use of a fastening device such as Velcro.

After the harness 15 is attached to the rifle, the rifle may be placed on a horizontal firing surface 31. The recoil absorption system must then be attached to the firing surface 31. The present invention requires the barrel 23 and/or forestock 25 of the rifle to be supported by some type of firing support 33 such that the barrel may rest in the horizontal firing position. This support may be in the form of a padded roll, a sandbag, a Y-shaped barrel support, a tripod of bipod, or a block attached to a table surface, amongst other supports known in the art.

The preferred embodiment of the present invention utilizes an attachment strap 21 that is stitched to the second small loop 19 on the rifle harness mentioned above. This attachment strap 21 may be a single strap or an extended portion of the large loop 17 mentioned above. The rifle is positioned 15 on the table 31, for instance, such that the attachment strap 21 hangs from its attachment to the harness and is allowed to hang over the front edge of the table 31 nearest the muzzle 35 of the rifle. In order to attach the recoil absorption device to the table 31, the attachment strap 21 is pulled underneath the table and attached to the rear edge of the table nearest the butt 29 of the stock of the rifle. The end of the attachment strap is fixed to the table by a U-shaped clamp 37 that may be temporarily fixed to the rear edge of the table. Once the clamp 37 is fixed to the rear edge of table, a tightening mechanism 11 such as a come-a-long cam 11 may be used to reduce the slack in the attachment strap between the rifle and the U-shaped clamp. Other examples of a tightening device or tensioning means include, but are not limited to, a locking pulley system, a winch type system, or any other similar system known in the art. This removal of slack and tightening ensures that the recoil generated while firing the rifle is transferred to the table or shooting surface.

The invention described above may easily be disconnected from the table 31 and remain on the rifle while a user is carrying the weapon. The invention is also easily removed from the rifle and stowed in a compact manner. The textile webbing construction of the device allows for easy stowing and weighs little and occupies little space in comparison to the prior art.

Another embodiment of the present invention features a one piece main loop 17 in which the loop extends to the rifle support device 33 and pivots 43 on the rifle support device 33 such that the harness 15 extends to the front edge of the table 41 and extends around the table to extend beneath the table in a generally parallel manner to the position of the rifle. Subsequently the harness loop is attached to a cam 11 that can be used for tightening and loosening the harness 15. Additionally a strap attaching the cam to the C-clamp 37 is also provided. The strap 39 is positioned such that when the cam is tightened, the recoil will be absorbed by the harness 15 and transferred to the strap 39 and the C-clamp 37 and subsequently to the shooting surface 31.

While there is shown and described the present preferred embodiment of the invention, it is to be distinctly understood that this invention is not limited thereto, but may be variously embodied to practice within the scope of the following claims. From the foregoing description, it will be apparent that various changes may be made without departing from the spirit and scope of the invention as defined by the following claims.

The invention claimed is:

1. A rifle recoil absorption system for attaching a rifle to a surface, wherein said rifle comprises a forestock, a stock, a butt, a muzzle, and a barrel, wherein said surface comprises a top, a bottom, a rifle support structure and an elevated barrel rest extending generally upward from said surface, said rifle recoil absorption system comprising:

a harness, said harness configured for absorption of recoil, said harness comprising a first loop configured for extending around said rifle butt, said first loop having two extensions, a first extension configured for extending on a first side of said rifle and a second extension configured for extending on a second side of said rifle, said extensions configured for extending generally adjacent to said stock and said forestock towards said muzzle, wherein said first loop is configured to absorb recoil force generated when said rifle is fired;

a second loop attached to said first extension of said first loop, said second loop attached adjacent to a first side of said forestock and configured for extending in a generally perpendicular direction from said first loop, said second loop configured for extending generally over a top of said barrel and attached to said first loop at a point adjacent to said second side of said forestock and generally opposite of said attachment point on said first side of said forestock, wherein said second loop is configured to absorb rifle kick back force when said rifle is fired;

wherein said first extension and said second extension are configured to extend generally toward said muzzle to a point wherein said extensions are configured to extend towards a front edge of said surface and configured to extend under said shooting surface, and a tensioning means attached to said first extension and said second extension beneath said surface, wherein said tensioning means is attached to said surface, said tensioning means is configured to tighten and loosen said harness by lengthening and shortening said harness such that when said harness is tightened said harness is configured to support said rifle such that said harness is configured to absorb recoil force and kickback force generated when said rifle is fired.

2. The rifle recoil absorption system of claim 1, wherein at least one of said first loop or said second loop is comprised of a textile webbing material.

3. The rifle recoil absorption system of claim 1, wherein said second loop is adjustable to tightly circumvolve said barrel and said forestock of said rifle using a hook and loop system.

4. The rifle recoil absorption system of claim 1, wherein said harness of said rifle recoil absorption system further comprises a third loop, said third loop attached to said first extension and said second extension of said first loop, said third loop configured to circumvolve said stock to minimize movement of said first loop in relation to said stock.

5. The rifle recoil absorption system of claim 4, wherein said third loop is attached to said first loop generally adjacent to said first side of said stock, said third loop configured for extending in a generally perpendicular direction from said first loop, said third loop configured to extend generally over and around said top of said stock and is attached to said harness generally opposite of said third loop attachment location on said first side of said stock, said third loop configured to continue in a generally perpendicular direction down from said harness adjacent to said second side of said stock and generally under and around said stock, said third loop being generally attached to said harness at a point generally adjacent to said first side of said stock and at a point generally opposite of said third loop attachment point adjacent to said second side of said rifle stock.

6. The rifle recoil absorption system of claim 5, wherein said third loop is configured to be adjustable in circumference.

7. The rifle recoil absorption system of claim 6, wherein said third loop uses a hook and loop system to be adjustable in circumference.

8. The rifle recoil absorption system of claim 4, wherein at least one of said first loop, said second loop, or said third loop is further comprised of a textile webbing material.

9. The rifle recoil absorption system of claim 1, wherein said second loop of said rifle recoil absorption system is configured to extend generally downward from said attachment point generally adjacent to said first side of said rifle forestock, said loop configured to extend generally around a bottom of said forestock and configured to extend and to connect at said attachment point of said second loop adjacent to said second side of said forestock such that said second loop is configured for circumvolving engagement of said rifle barrel and forestock.

10. The rifle recoil absorption system of claim 1, wherein said tensioning means further comprises:

an attachment hook removably attached to said surface;

an attachment strap attached to said attachment hook; and a cam system attached to said attachment strap, wherein said cam system is configured such that said harness can be pulled through said cam to generate tension on said harness and said cam can be released to decrease tension on said harness.

11. A rifle recoil absorption system for attaching a rifle to a surface, wherein said rifle comprises a forestock, a stock, a rifle butt, and a barrel, wherein said surface comprises a rifle support structure and an elevated barrel rest, said rifle recoil absorption system comprising:

a rifle harness, said rifle harness comprising a primary loop of band material configured for use with said rifle, wherein said primary loop is configured to extend from a first side of said forestock of said rifle to a first side of said rifle stock, around said butt of said rifle, and to extend past a second side of said stock and toward said forestock, wherein said primary loop is configured for absorption of recoil;

a first rifle coupling of a band material attached to said primary loop adjacent to said rifle stock, wherein said first rifle coupling forming a secondary loop generally perpendicularly attached to said primary loop on a first side and a second side of said stock, said first rifle coupling configured for circumvolving engagement of said stock of said rifle for securing said harness to said rifle stock;

a second rifle coupling of a band material attached to said primary loop generally adjacent to said rifle forestock, said second rifle coupling configured to form a tertiary loop generally perpendicularly attached to said primary loop on a first and second side of said forestock, said tertiary loop configured for circumvolving engagement with said forestock and said barrel of said rifle generally perpendicular to said primary loop, said second rifle coupling configured to secure said harness to said rifle at a forward position of said rifle;

an attachment hook for attachment of said rifle harness to a rearward portion of said shooting surface, said attachment hook configured for absorbing recoil of said rifle when fired; and at least one anchor strap attached to said primary loop at a first end and to said attachment hook at a second end, said anchor strap configured for securing said rifle harness to said attachment hook such that when recoil is transferred to said primary loop said recoil is transferred to said anchor strap and to said attachment hook, and through tension of said anchor strap said rifle barrel is prevented from raising up from said rifle support structure from recoil.

12. The rifle recoil absorption system of claim 11 wherein said anchor strap is attached to said tertiary loop and configured to pass under said shooting surface and attach to said attachment hook.

13. The rifle recoil absorption system of claim 11 wherein said system further comprises a strap tightening and slack reducing device wherein said anchor strap is adjustable in length and tension using said strap tightening device.

14. The rifle recoil absorption system of claim 11 wherein said attachment hook further comprises an attachment clamp that attaches to the underside rear edge of said shooting surface nearest said butt of said rifle.

15. The rifle recoil absorption system of claim 11 wherein said attachment hook attaches to the underside of said shooting surface nearest said butt of said rifle.

16. The rifle recoil absorption system of claim 11 wherein at least one of said primary loop, said secondary loop, and said tertiary loop are constructed from textile webbing material.

17. The rifle recoil absorption system of claim 11 in which said anchor strap is an excess length of said primary loop attached to said tertiary loop and said attachment hook.

18. The rifle recoil absorption system of claim 11 in which said anchor strap is constructed of two independent bands of material each attached to said tertiary loop.

19. The rifle recoil absorption system of claim 11 wherein at least one of said secondary loop or said tertiary loop is configured to be adjustable to tightly circumvolve said barrel and forestock of said rifle using Velcro.

* * * * *